United States Patent [19]

Barnes, Jr. et al.

[11] 4,361,729

[45] Nov. 30, 1982

[54] NARROWBAND ANALOG MESSAGE PRIVACY SYSTEM

[75] Inventors: Laurence A. Barnes, Jr., Springfield; Ronald E. Irons, Reston, both of Va.

[73] Assignee: American Standard Inc., New York, N.Y.

[21] Appl. No.: 700,186

[22] Filed: Jan. 24, 1968

[51] Int. Cl.[2] ..... H04K 1/02

[52] U.S. Cl. ..... 179/1.5 R; 375/2.1; 455/30; 179/1.5 S

[58] Field of Search ..... 179/1.5, 1.5 R; 325/32

[56] References Cited

U.S. PATENT DOCUMENTS

| | | | |
|---|---|---|---|
| 2,406,841 | 9/1946 | Levy | 179/1.5 R |
| 2,543,116 | 2/1951 | Llewellyn | 179/1.5 R |
| 2,777,897 | 1/1957 | Gretener et al. | 179/1.5 R |
| 2,947,804 | 8/1960 | Eilers et al. | 179/1.5 R |
| 2,953,643 | 9/1960 | Koenig, Jr. | 179/1.5 R |
| 3,012,099 | 12/1961 | Busch et al. | 179/1.5 R |
| 3,025,350 | 3/1962 | Lindner | 179/1.5 R |
| 3,029,309 | 4/1962 | Van Jepmond | 179/1.5 R |
| 3,077,518 | 2/1963 | Guanella | 179/1.5 R |
| 3,123,672 | 3/1964 | Ross | 179/1.5 R |
| 3,133,991 | 5/1964 | Guanella | 179/1.5 R |
| 3,225,142 | 12/1965 | Schroeder | 179/1.5 R |
| 3,515,805 | 6/1970 | Fracassi et al. | 178/22 |

OTHER PUBLICATIONS

OSRD Report No. 3802, dated Nov. 1, 1944, for "Articulation Testing Methods II", J. P. Egan, Psycho-Acoustic Laboratory, Harvard University, Cambridge, Mass.

"Linear Recurring Sequences", Zierler, *Journal of the Society of Industrial and Applied Mathematics*, pp. 31–48, Mar. 1959.

"Some Simple Self-Synchronizing Digital Data Scramblers", Savage, *Bell System Technical Journal*, Feb. 67, vol. 46, No. 2, pp. 449–487.

*Primary Examiner*—Howard A. Birmiel

*Attorney, Agent, or Firm*—Robert G. Crooks; James J. Salerno, Jr.; John P. Sinnott

[57] ABSTRACT

A privacy system in which an analog information-bearing signal is linearly combined with a noiselike coding waveform to produce a composite waveform of unrecognizable, scrambled signal for transmission to an authorized system user at a remote receiving terminal. The noiselike waveform is developed from the original information signal, and the original signal reproduced from the composite waveform, to eliminate any need for synchronization between transmitter and receiver. At the transmitting terminal, the composite waveform is infinitely clipped and amplified to produce a digital format which is serially fed through a shift register in accordance with shift pulses derived from the clipped signal transitions. Various outputs of the several stages of the shift register are selectively applied, via a switching matrix, to an encoder which generates the noiselike or pseudo-random signal therefrom. After passage through a narrowband filter, the coding waveform is added in a linear mixer to the original information signal for transmission. An inverse operation is performed at the receiving terminal.

6 Claims, 3 Drawing Figures

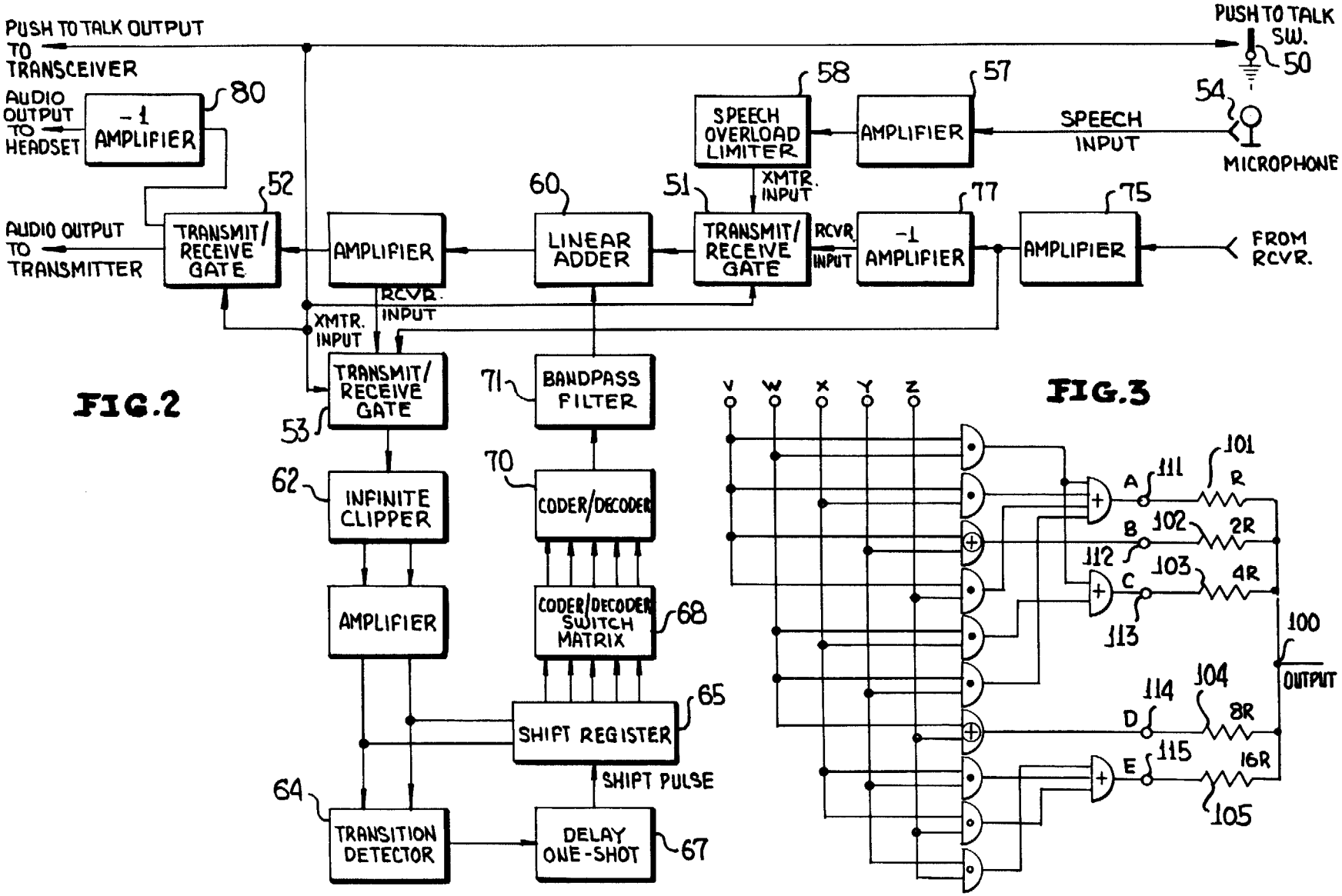
PUSH TO TALK SW.
50
MICROPHONE
54
SPEECH INPUT
FROM RCVR.
75
AMPLIFIER
57
AMPLIFIER
77
-1 AMPLIFIER
58
SPEECH OVERLOAD LIMITER
XMTR. INPUT
RCVR. INPUT
TRANSMIT/ RECEIVE GATE
51
LINEAR ADDER
60
BANDPASS FILTER
71
CODER/DECODER
70
CODER/DECODER SWITCH MATRIX
68
SHIFT REGISTER
65
SHIFT PULSE
DELAY ONE-SHOT
67
AMPLIFIER
RCVR. INPUT
XMTR. INPUT
TRANSMIT/ RECEIVE GATE
53
INFINITE CLIPPER
62
AMPLIFIER
TRANSITION DETECTOR
64
52
TRANSMIT/ RECEIVE GATE
80
-1 AMPLIFIER
PUSH TO TALK OUTPUT TO TRANSCEIVER
AUDIO OUTPUT TO HEADSET
AUDIO OUTPUT TO TRANSMITTER
FIG.2
FIG.3
100
OUTPUT
101
R
2R
4R
8R
16R
105
104
102
103
111
112
113
114
115
A
B
C
D
E
V
W
X
Y
Z

NARROWBAND ANALOG MESSAGE PRIVACY SYSTEM

BACKGROUND OF THE INVENTION

The present invention relates generally to secrecy communication systems and more particularly to systems for narrowband analog transmission of messages with privacy.

It is a principal object of the present invention to provide a speech privacy system in which an analog message signal is linearly mixed with a noiselike signal to produce an apparently random composite waveform wherein the original message signal is completely masked and is unavailable to all except authorized users of the system.

A wide variety of communication secrecy or privacy systems have been proposed in the past twenty-five years, most of these characterized in that one or more parameters of the message are varied or modified in some arbitrary or random fashion at the transmitter, and these scrambled or jumbled parameters subsequently returned to their original form at the receiver of an authorized party. In general, decoding is accomplished from a knowledge of the scrambling technique used at the transmitter and by means of some form of synchronization of transmitted and received signals and their scrambling and unscrambling waveforms.

Among the first techniques of masking intelligible messages was the addition of "noise" to the message to produce a signal buried in obscuring noise. At the receiver, the output of a local source of noise corresponding identically to that used at the transmitting terminal, and synchronized with the transmitter noise source and the message signal, was subtracted from the signal plus noise to produce the original message. Obviously, such a system is relatively ineffective to prevent "evesdropping" because it is merely necessary to suppress the noise in some suitable fashion whereby to obtain the recognizable signal pattern buried therein.

A subsequent system was suggested in which signal parameters such as amplitude and phase were altered according to frequency, prior to adding noise thereto, in order to provide an additional quantity unknown to those unauthorized persons seeking to unscramble the message. It was then much more difficult to obtain the desired information, absent identical synchronized demodulation equipment at the receiver, since there was involved more than a simple subtraction or suppression of noise from signal. Nevertheless, the additional pattern by which the signal was modified was a regular, (i.e., not random) format and could conceivably be derived in short order by suitable iterative or trial and error techniques. This was particularly true because once the noise was suppressed, at least some regular format was observable, and it then remained only to find the key by which that format was modified on the basis of frequency or phase, or both.

Another approach previously taken in speech privacy transmission systems involves the provision of means for scrambling message waves in an arbitrary manner approaching a random or a pseudo-random order extending over a lengthy period, before a repetition of the complete code cycle is begun to transmit further message fragments. Privacy is enhanced since an unauthorized party must first discover the code element by element because of the lack of a recurring scheme of scramble within the long code cycle by which to enable decoding of the message in blocks of substantial length.

Still another prior art system utilizes the diverging of the frequency order of the speech or signal wave by modulation of a continuous wave of appropriate frequency, and selection of the lower sideband for transmission. Additional irregularity is introduced by inserting non-cyclic variations into the inverting wave itself, these variations being non-repeated during the message transmission.

In yet another secrecy communication system the speech amplitudes are first converted into pulse combinations and are subsequently enciphered by employment of telegraphy coding methods. The pulse combinations are obtained by a form of speech quantizing together with scanning to produce a code in which each pulse combination corresponds to a speech amplitude lying between two specified limits, and the variable amplitude of the speech is then transmitted in the form of a sequence of these pulse combinations.

Still another method of operating a secrecy communication system involves alteration of an intelligence or message signal by abruptly varying a characteristic of the signal at predetermined intervals in accordance with a coding schedule. The altered intelligence signal is then sampled at points in time differing from the times at which the aforementioned characteristic was abruptly varied to produce an output signal consisting of the sampled portions of the altered intelligence signal. Before transmission, the output signal wave form is shaped to simulate that of the altered intelligence signal prior to sampling.

According to still another approach to secrecy communication, a series of signal generators individually producing a signal having an indentifiable characteristic are actuated in a random sequence. One of the signal generators is also randomly selected for actuation in accordance with operating condition of the mechanism for random selection of the overall series of signal generators so as to produce a series of code bursts.

In another security communication system the coding is effected on the basis of a plurality of mutually orthogonal functions resembling noise in appearance, and the message signal sampled in accordance with this coding technique is transmitted by means of code groups representing amplitude of samples which are substantially randomly distributed by means of the same sampling technique to several different carrier channels.

A still further method and apparatus for masking communication signals in the prior art has consisted of generating at the transmitting terminal of the system a sequence of pulses one parameter of which is modulated by a combined signal consisting of communication signal and a concealing supplementary signal by use of a sawtooth switching arrangement. A similar switching arrangement is utilized to decode the pulses picked up at the receiver. In still another method for camouflaging communication signals a first series of pulses modulated by the intelligence signal is combined at the transmitting station with an additional series of pulses of arbitrarily varying polarity, to produce a composite pulse series. A series of control pulses is transmitted along with the composite pulse series to the receiving station where an arrangement identical to that used at the transmitting station is employed to reproduce the aforementioned additional series of pulses for application to the composite pulse series, to reconvert the latter into the original series of pulses.

According to another speech security system of the prior art, a low amplitude quieting voltage having a frequency at the lower end of the system passband is applied to a speech signal into which randomly timed phase reversals have been introduced, by which to enhance the scrambling of the transmitted signal. A special squelch circuit is utilized to suppress any audio output of the system in the absence of speech so as to eliminate the otherwise noticeable intersyllable noise.

In another prior art privacy system the intelligence signal is scrambled by passing it through a linear filter at a transmitting station whereby to add time inverted reverberation to the signal and thus provide it with a substantial number of pre-echos of amplitude and polarity which render it unintelligible to unauthorized receivers.

While such prior art methods, both digital and analog, have served some utility as message privacy systems, each has required synchronization between transmitter and receiver and each is further generally characterized by system complexity of an extent which has thus far rendered privacy systems to be of prohibitive cost.

It is therefore a further object of the present invention to provide a speech privacy system capable of narrowband transmission of analog signal in an unrecognizable composite waveform, in a manner that overcomes one or more of the disadvantages of the prior art privacy or secrecy systems.

SUMMARY OF THE INVENTION

Briefly, the present invention resides in the generation of a noiselike or pseudo-random waveform from the original speech signal, and in the linear addition of the noiselike waveform to the speech signal to form a composite narrowband noiselike signal. At the receiving terminal the detected composite signal is inverted and, as well, is utilized to produce a substantial replica of the noiselike waveform used in the coding of corresponding portions of the original signal at the transmitter. The reproduced noiselike waveform is linearly added to the inverted composite signal to synthesize an inverted version of the original speech signal, which is subsequently inverted and converted to sound. Regeneration of the noiselike waveform at the receiving terminal corresponds identically to the operation performed at the transmitter for producing the encoding noiselike waveform.

BRIEF DESCRIPTION OF THE DRAWINGS

The above and still further objects, features and attendant advantages of the present invention will become apparent from a consideration of the following detailed description of the preferred embodiment thereof, especially when taken in conjunction with the accompanying drawings, in which:

FIG. 2 is a detailed block diagram of one terminal of the system of FIG. 1, suitable for transmission and reception; and FIG. 3 is a logic circuit diagram suitable for use as the encoder/decoder circuit in the terminal of FIG. 2.

DESCRIPTION OF THE PREFERRED EMBODIMENT

Figure 1:
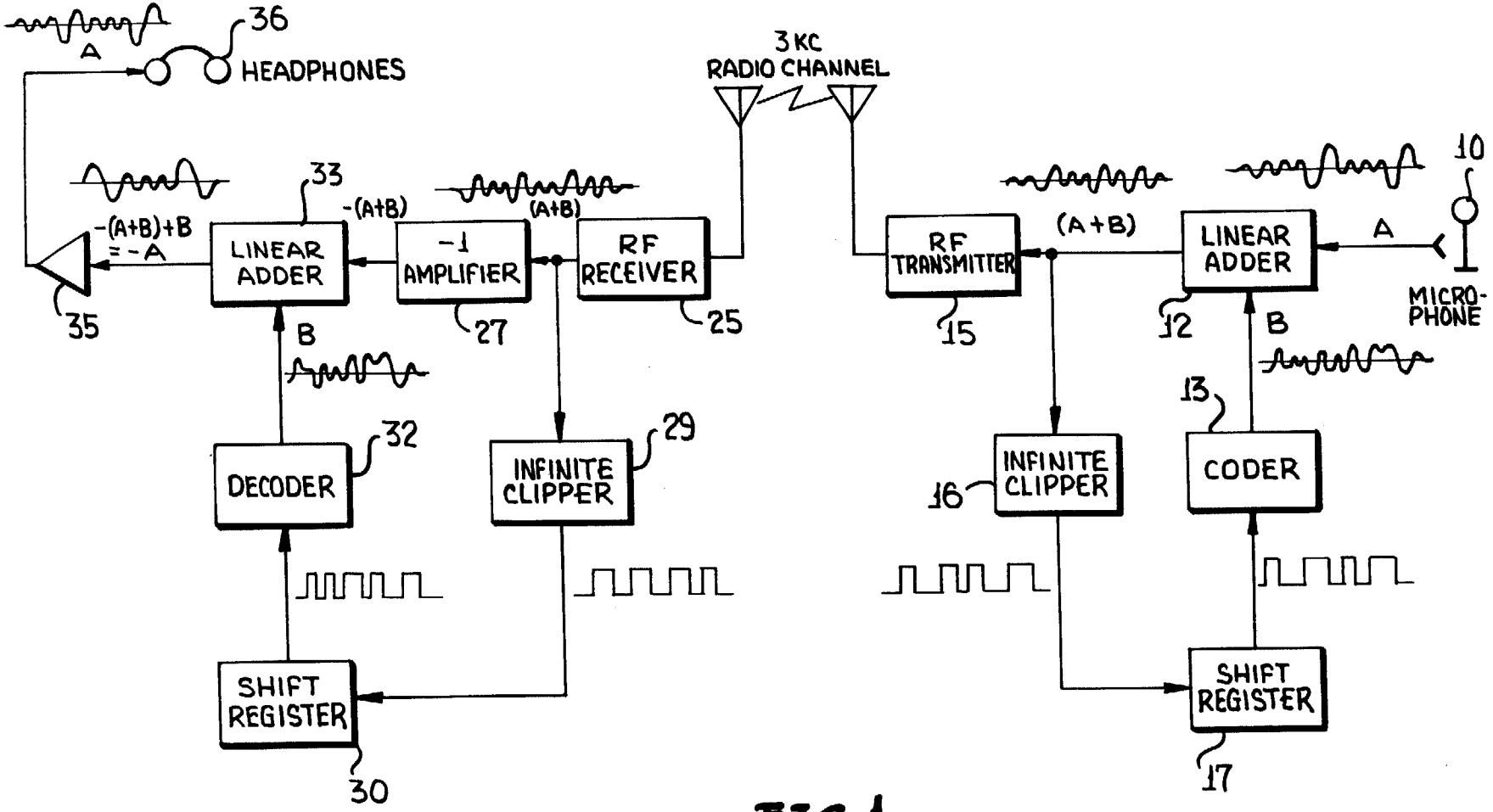
FIG. 1 is a simplified block diagram of the overall speech privacy system.

Referring now to FIG. 1, wherein is shown a simplified block diagram of an analog speech privacy system according to the invention, a microphone 10 is provided to permit application of a speech input A to a linear adder 12. Exemplary waveforms indicative of the general shape of the signal at various points along the path are shown in FIG. 1 for the sake of clarity, but are not to be taken as a rigorous exposition of signal format.

Linear adder 12 may take the form of a resistive mixer or other circuit conventionally utilized for that purpose, to additively combine speech input A with the analog output B of a cyclic code generator 13, the latter signal constituting a noiselike waveform of nominally 3-kc bandwidth. As previously observed, the simple mixing of a speech waveform with noise to provide speech privacy is an old concept per se. According to the present invention, however, the noiselike signal is a scrambling code generated directly from the transmitted signal, in a manner to be described presently, and the original speech input is regenerated at the receiving terminal of the system in such a manner that transmitter and receiver may operate without special frame synchronization signals, thereby significantly simplifying operation of the system.

The output A + B of linear adder 12 is used to modulate the carrier by r-f transmitter 15, and is also applied in parallel to an infinite clipper 16 which removes those portions of the waveform immediately above a fixed level at either side of the signal axis. Accordingly, the output signal of the infinite clipper is a digital format which is to be utilized to load the several stages of a shift register 17. As will be explained in greater detail in the ensuing description, the infinitely clipped waveform is fed into shift register 17 at a rate determined by its axis-crossing rate.

The contents of the shift register stages are applied in parallel to coder 13, but only certain of these outputs are combined, in accordance with a selected coding format known only to authorized users, to produce the noiselike signal B as an output of the coder. Waveform B is preferably restricted to a 3-kc bandwidth and is linearly added to speech signal A to produce A + B, the scrambled signal. In essence, this is a pseudo-random analog voltage and may be transmitted over a conventional narrowband (3-kc) channel in any convenient fashion. Simple single sideband AM transmission or FM modulation of the r-f link is perfectly suitable.

At the receiving terminal of the 3-kc radio channel, the audio output of the receiver 25 is the noiselike signal A + B corresponding to that originally generated at the output circuit of linear adder 12 of the transmitting terminal. The detected signal A + B is applied in parallel to an inverting amplifier 27, to obtain a signal −(A + B), and to an infinite clipper 29, which like its counterpart at the transmitting terminal forms a digital waveform for application to a shift register 30, also identical to that at the transmitter. By use of a decoder 32 corresponding to identically to the encoder 13 at the transmitter, in terms of fixed structure and of aforementioned selected coding format, and applying the contents of shift register 30 in parallel thereto, a waveform B corresponding ideally to that produced by the cyclic code generator of the transmitting terminal is developed at the output terminals of decoder 32.

The signals designated B and −(A + B) are fed to a linear adder 33, also identical to its counterpart at the transmitter, to produce the output waveform −(A + B) + B, or simply −A. A second inversion is effected, by inverting amplifier 35, to reproduce the original speech waveform A, or a reasonably close approximation thereof, for application to headphones 36, speaker, or other electroacoustic transducer.

As shown in greater detail in FIG. 2, each terminal of the speech privacy system according to the present invention is a half-duplex terminal capable of both transmission and reception of encoded speech signals, on a separate selected basis, of course. In the transmit mode, push-to-talk switch 50 is actuated to simultaneously key the r-f transmitter (of a transceiver, not shown) and enable three transmit/receive (T/R) gates 51, 52, 53. The speech signal deriving from dynamic microphone 54 is amplified and overload limited to a predetermined amplitude by units 57 and 58, respectively, and applied via T/R gate 51 to linear adder 60.

The output signal of the linear adder, which corresponds to scrambled waveform A+B at the transmitting terminal of FIG. 1, is amplified and applied in parallel to T/R gates 52 and 53. The amplified signal is fed through T/R gate 53 to infinite clipper 62, the infinitely clipped digital-type output waveform of which is amplified for application of digital signal of the general form shown at the output path of infinite clipper 16 of FIG. 1 in parallel to transition detector 64 and shift register 65. The shift register may have twenty stages which are successively loaded in response to shift pulses from a delay (one-shot) multivibrator 67. In a usual manner, a new digit is inserted in the first stage, the contents of each stage shifted to the next successive stage, and the contents of all stages read out in parallel, with the application of each shift pulse to register 65. Transition detector 64 is simply an axis crossing detector responsive to zero crossings of the amplified infinitely clipped signal (corresponding to transitions of waveform A+B) to generate a positive pulse for triggering one-shot multivibrator 67 to its unstable state. The pulse generated upon return of the one-shot to its stable state is effectively a delayed version of the positive pulse output of detector 64, and is applied to the shift register 65 as a shift pulse therefor. It is to be observed that this method of generating a shift pulse results in a continually varying clock rate and eliminates any requirement of bit synchronization between terminals of the system. As previously noted, frame synchronization is rendered unnecessary as a result of the method of generating a scrambling code directly from the transmitted signal and the identical generation of an unscrambling code directly from the received signal.

An output from each of the stages, e.g., flip-flops, of shift register 65 is fed to a respective preselected switch of coder/decoder switch matrix 68. For a 20-bit shift register a 4×5 coding switch matrix, of conventional design, will suffice. In a preferred embodiment, the outputs of five selected switches of the matrix are fed to coder/decoder circuitry 70 of a type to be described in detail in conjunction with FIG. 3. For the present, it is sufficient to note that the switch coding or selection arrangement to permit passage of only certain ones, or combinations thereof, of the outputs of the shift register stages is known only to authorized users, and may be changed several times daily, or at other intervals, according to a prearranged or extemporaneously agreed upon schedule. The switch selection at the receiving terminal must be identical to that at the transmitting terminal for any given message.

The output of coder/decoder circuitry 70 is a noiselike analog signal B as previously observed at the output of coder 13 in the simplified embodiment of FIG. 1. In essence, signal B is a multilevel waveform which is first filtered by bandpass filter 71 (e.g., 3-kc bandwidth), and then applied to linear adder 60 for combination with input speech signal A. The output of the linear adder is the 3-kc bandwidth scrambled composite signal A+B which modulates the r-f carrier (when T/R gate 52 is in the transmit mode) and is fed back to the cyclic code generator.

It should be noted that since the actual code level B to be added to audio input signal A is dependent upon composite signal A+B, which is continuously varying, the generated code is likewise continuously varying.

In the receive mode of operation of the half duplex terminal of FIG. 2, the detected signal A+B from the r-f receiver is applied to amplifier 75 and the amplified version inverted by inverting amplifier 77. The output of the inverter is fed via T/R gate 51, now having its receive path enabled, to linear adder 60 as waveform −(A+B). In addition, the output of amplifier 75 is applied to infinite clipper 62 via the receiver pat of T/R gate 53, to ultimately produce the coding waveform B in the manner described earlier. Accordingly, linear adder 60 receives both waveforms −(A+B) and B, and generates an output of −(A+B)+B or simply −A. Upon application to inverting amplifier 80 via the receive path of T/R gate 52, this signal is inverted to reproduce the original speech input signal A.

A suitable embodiment of the coder/decoder 70 of FIG. 2 is shown in FIG. 3. It is to be emphasized, however, that any means for generating a noiselike or pseudo-random signal from the input speech signal in the previously described manner may alternatively be used. Referring now to FIG. 3, the coder/decoder circuit has five input terminals for receiving input signals v, w, x, y, z from switch matrix 68, an interconnected group of logic gates to implement AND (·), OR (+), and EXCLUSIVE OR (⊕ or) functions, a plurality of weighting resistors, and a summing node from which the output is taken.

In particular, it is the purpose of the circuit of FIG. 3 to implement the general equation $$N = a_1A + a_2B + a_3C + a_4D + a_5E$$

where N is the output signal taken from summing node 100; $a_1$, $a_2$, $a_3$, $a_4$, $a_5$ are weighting coefficients determined by the selected relative values of resistors 101–105, respectively; and A, B, C, D, E are the logical output functions taken from nodes 111–115, respectively, and given by:

$$A = f_1(v,w,x,y,z) = (v\cdot w) + (v\cdot x) + (v\cdot z) + (w\cdot y)$$

$$B = f_2(v,y) = (v\cdot y) + (\bar{v}\cdot\bar{y})$$

$$C = f_3(v,w,x) = (v\cdot w) + (w\cdot x)$$

$$D = f_4(w,z) = (w\cdot z) + (\bar{w}\cdot\bar{z})$$

$$E = f_5(x,y,z) = (x\cdot y) + (y\cdot z) + (x\cdot z)$$

where f ( ) has its conventional symbolic meaning "function of (the terms in parentheses)", and the bar over a term indicates inversion or negation.

It can be shown that the five logical inputs, which produce 32 ($2^5$) input combinations, undergo logic operations and weighting to effect the generation of twenty-one distinct levels in a noiselike code constituted by the output signal N. The speech signal is linearly added to this output, and since the noiselike code is derived from the speech signal itself, there exists a correlation between the speech signal and the code in which it is hidden. The extent of the correlation determines the threshold at which the composite signal becomes incomprehensible as the noise output is increased relative to signal level.

While we have disclosed a preferred embodiment of our invention, it will be apparent that variations of the details of construction specifically illustrated and described herein may be resorted to without departing from the spirit and scope of our invention, as defined by the appended claims.

We claim:

1. A self-synchronizing message privacy system having a transmitting terminal and a receiving terminal, and comprising, at the transmitting terminal, means for generating a noiselike waveform, means for linearly combining said noiselike waveform with an analog message signal to be transmitted to the receiving terminal to produce a composite scrambled signal, and means for transmitting said composite signal to said receiving terminal; said generating means including an infinite clipper responsive to said composite signal for conversion thereof to a digital format, a multi-stage shift register for serially accepting said digital format, means responsive to axis transitions of said digital format for applying shift pulses to said shift register in accordance therewith, whereby to successively shift the contents of each stage to the next successive stage, means for logically combining those of the contents of the shift register applied thereto to produce a varying multilevel format constituting said noiselike waveform, and switch means for selectively applying contents of said shift register to said logical combining means.

2. The system according to claim 1 wherein is further included a bandpass filter for supplying the noiselike waveform to said linear combining means in narrowband format.

3. The system according to claim 1 wherein said transmitting terminal includes means for conversion thereof to a receiving terminal, said terminal conversion means including first means for selectively supplying said message signal or an inverted version of the composite waveform detected by a receiver to said linear combining means, second means for selectively supplying the first-mentioned composite signal or said detected composite signal to said infinite clipper, and means for synchronizing the operation of said first and second selective supplying means.

4. The combination according to claim 1 further including, at said receiving terminal, means responsive to the transmitted composite signal for inversion thereof, means responsive to the inverted composite signal and to a further noiselike waveform substantially corresponding to the first-named noiselike waveform for linear combination thereof to produce an inverted version of said message signal, and means responsive to said inverted message signal for reproducing the original message signal therefrom; and wherein said further noiselike waveform is produced by means corresponding to said generating means at said transmitting terminal, in response to said transmitted composite signal.

5. The system according to claim 4 wherein each of the linear combining means at said transmitting terminal and said receiving terminal comprises a linear adder.

6. A self-synchronizing speech privacy system comprising means for generating a noiselike waveform, means responsive to analog speech signal and to said noiselike waveform for linear mixing thereof to produce a composite scrambled signal for transmission to a receiver; means at said receiver for reproducing the original speech signal, including further means for generating a noiselike waveform, and means responsive to the last-named noiselike waveform and to composite signal detected from the transmitted composite signal for linear mixing thereof to produce a synthesized version of said original speech signal; the first-mentioned and further means for generating a noiselike waveform each comprising means for converting the composite signal to a digital format, a shift register for accepting the digital format, logic means for combining at least a portion of the contents of the shift register to produce the respective noiselike waveform, and switch means for selectively applying the contents of each stage of said shift register to said logic means.

* * * * *